US005662274A

United States Patent [19]

Koga et al.

[11] Patent Number: 5,662,274

[45] Date of Patent: Sep. 2, 1997

[54] FUEL INJECTOR FOR AN INTERNAL COMBUSTION ENGINE

[75] Inventors: Nobuhiko Koga, Susono; Keiso Takeda; Yoshiyuki Tamaki, both of Mishima, all of Japan

[73] Assignee: Toyota Jidosha Kabushiki Kaisha, Aichi, Japan

[21] Appl. No.: 546,181

[22] Filed: Oct. 20, 1995

[30] Foreign Application Priority Data

Nov. 4, 1994 [JP] Japan ..... 6-271190

[51] Int. Cl.[6] ..... F02M 51/06

[52] U.S. Cl. ..... 239/533.2; 239/585.5

[58] Field of Search ..... 239/585.1–585.5, 239/533.3–533.12

[56] References Cited

U.S. PATENT DOCUMENTS

| | | | |
|---|---|---|---|
| 4,637,554 | 1/1987 | Takeda | 239/585.3 X |
| 4,700,891 | 10/1987 | Hans et al. | 239/132.5 |
| 4,717,080 | 1/1988 | Sauer | 239/585.4 X |
| 4,771,984 | 9/1988 | Szablewski | 239/585.4 X |
| 5,222,674 | 6/1993 | Hans et al. | 239/585.5 |

FOREIGN PATENT DOCUMENTS

| | | | |
|---|---|---|---|
| 62-70655 | 4/1987 | Japan . | |
| 62-139970 | 6/1987 | Japan . | |
| 1-41828 | 9/1989 | Japan . | |
| 136476 | 5/1992 | Japan | 239/585.4 |
| 209963 | 7/1992 | Japan | 239/585.4 |
| 209964 | 7/1992 | Japan | 239/585.4 |
| 5-500256 | 1/1993 | Japan . | |

*Primary Examiner*—Kevin Weldon
*Attorney, Agent, or Firm*—Kenyon & Kenyon

[57] ABSTRACT

A fuel injector for an internal combustion engine includes a valve body which has a nozzle at one end. A stopper plate is located at the other end of the valve body and has a path for communicating between the upstream and the downstream sides of said stopper plate itself. A needle valve is slidably disposed in the valve body for opening and closing the nozzle. A lift stopper is fixed to the needle valve for limiting the stroke of the needle valve in association with the stopper plate and has at least one path for communicating between the upstream and downstream sides of the lift stopper itself. A first needle guide is fixed to the needle valve at the downstream side of the lift stopper and has at least one path for communicating the upstream and the downstream sides of the first needle guide itself. A second needle guide is fixed to the needle valve at the upstream side of the lift stopper and has at least one path for communicating the upstream and the downstream sides of the second needle guide itself. The second needle guide guides the needle valve so that the needle valve is correctly moved, along the center axis, in association with the first needle guide.

6 Claims, 2 Drawing Sheets

FUEL INJECTOR FOR AN INTERNAL COMBUSTION ENGINE

BACKGROUND OF THE INVENTION

1. Field of the Invention

The present invention relates to a fuel injector and particularly relates to a spark ignited internal combustion engine.

2. Description of the Related Art

In the case of an engine which equipped with a fuel injector in which a needle valve moves in a valve body, when the engine is stopped in a hot condition and restarted before the engine has cooled down, bubbles generated between the valve body and the needle valve are mixed in the fuel, so that it becomes difficult to inject the correct amount of fuel and an insufficient amount of fuel may be injected. Consequently the air-fuel ratio of the intake mixture becomes lean, which cause poor initial firing and excessive exhaust emissions.

Therefore, a fuel injector which can move the bubbles in the fuel injector to the delivery line quickly, by enlarging a path for communicating between upstream and downstream sides of a horse-shoe shaped stopper plate, is disclosed in Japanese Unexamined Patent Applications (Kokai) No. 62-70655, National Publication of International Patent Application No. 5-500256 and Japanese Examined Patent Application (Kokoku) No. 1-41828.

However, the above described fuel injector requires increased manufacturing man-hour for machining to enlarge a path for communicating between upstream and downstream sides of the horse-shoe shaped stopper plate.

SUMMARY OF THE INVENTION

In view of the problem of the related art, the object of the invention is to provide a fuel injector for an internal combustion engine which can inject the correct amount of fuel at the restarting of the engine when the engine is hot.

According to the present invention, there is provided a fuel injector for an internal combustion engine which comprises a valve body having a nozzle at one end, a stopper plate located at the other end of said valve body and having a path for communicating between upstream and downstream sides of said stopper plate itself, a needle valve slidably disposed in said valve body for opening and closing said nozzle, a lift stopper fixed to the needle valve for limiting the stroke of the needle valve in association with the stopper plate, a first needle guide fixed to the needle valve in a downstream side of the lift stopper and having at least one path for communicating between the upstream and the downstream sides of the first needle guide itself, and a second needle guide fixed to the needle valve in an upstream side of the lift stopper for guiding the needle valve, in association with the first needle guide, along the center axis of the valve and having at least one path for communicating between the upstream and the downstream sides of the second needle guide itself.

BRIEF DESCRIPTION OF THE DRAWINGS

The present invention will be better understood from the description as set forth hereafter, with reference to the accompanying drawings, in which.

DESCRIPTION OF THE PREFERRED EMBODIMENT

Figure 1:
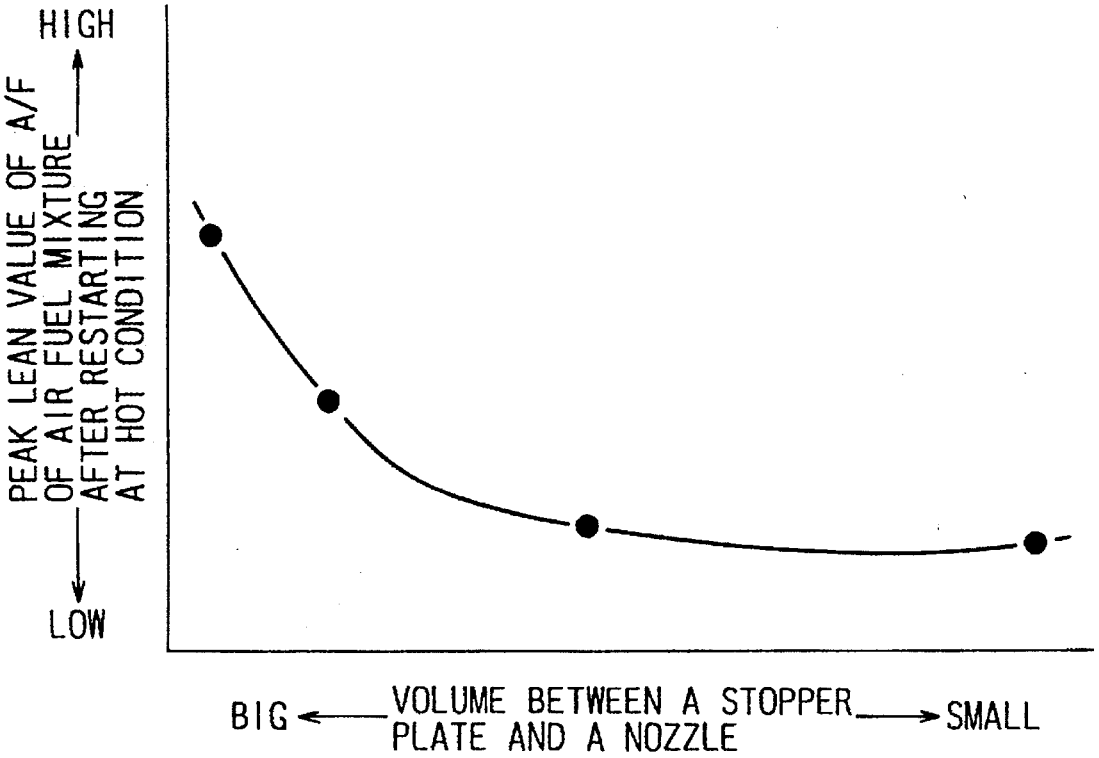
FIG. 1 is a diagram showing peak lean value of the air-fuel mixture at the restarting of an engine in a hot condition in relation to the volume between the stopper plate and the injection nozzle.

The diagram shown in FIG. 1 is the inventors' knowledge obtained by tests, and shows that the greater the volume between the stopper plate and the injection nozzle the more the peak lean value of the air-fuel mixture at the restarting of an engine in a hot condition decreases. This is because a relatively large amount of fuel liquid remains in the top portion of the fuel injector and fewer bubbles are included in the initially injected fuel when the volume between the stopper plate and the injection nozzle is increased and, subsequently, the fuel in the top portion of the injector is well cooled and the bubbles become smaller or disappear due to the large amount of cool fuel introduced into the volume. As a result the fuel injector can begin to inject the correct amount of fuel in a short time and the initial firing and the following firings are improved.

Preferably, the volume between the stopper plate and the nozzle is chosen to be 0.06% of the amount of fuel injected in one minute.

Figure 2:
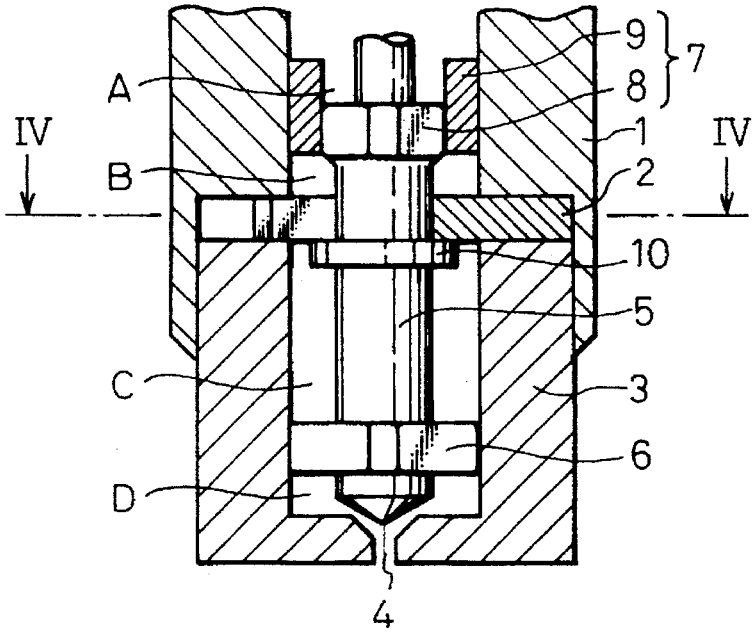
FIG. 2 is a partial sectional view of a fuel injector according to the present invention.

FIG. 2 is a partial sectional view showing a construction of the top part of the fuel injector according to the present invention. Referring to FIG. 2, reference numeral 1 represents a housing and, at the bottom of the housing 1, a valve body 3 is attached to the housing through a stopper plate 2. An injection nozzle 4 is located at the center of the bottom of the valve body 3.

Reference numeral 5 represents needle valve, reference numeral 6 represents a first guide located under the stopper plate 2, reference number 7 represents a second guide located above the stopper plate 2. The second guide 7 is composed of a flanged guide 8, which is formed on the needle valve 5, and an armature 9 which is fixed to the flanged guide 8 by welding or caulking.

The needle valve 5 is reciprocally moved in the valve body 3 in alignment with its center axis by the magnetic force of a solenoid coil (not shown) which acts on the armature 9, so that fuel is injected from nozzle 4.

Reference numeral 10 represents a lift stopper 10 which limits an upward stroke of the valve body 3.

The first guide 6 is formed so as to slidably contact the inner surface of the valve body 3 through only part of the circumference. For example, in a fuel injector according to this embodiment, the first guide 6 contacts the inner surface of the guide body 3 at four points so that at four points in this embodiment, therefore fuel flows through paths formed at portions where the first guide 6 and the valve body 3 do not contact each other.

The armature 9 of the second guide 7 is cylindrically shaped and the whole outer surface slidably contacts the inner surface of the housing 1. The armature 9 is fixed to the flanged guide 8 at number of points in the same manner described above in regard to the contact between the first guide 6 and the valve body 3 to provide paths through which fuel can flow.

However, the important point of the present invention is that the first guide 6 and the second guide 7 are separately located on both sides of the stopper plate 2, and the shape of the guide and the method of guiding are less important.

What is required of the guides is to guide the needle valve 5 correctly so that the needle valve 5 can move in alignment which its center axis and to provide paths which communicate one side of the guide to the other, for example areas A and B, and areas C and D in FIG. 2.

Figure 3:
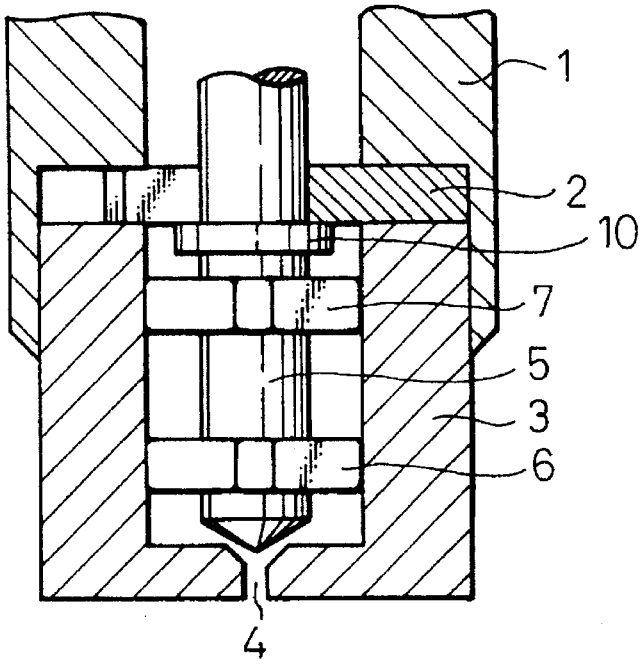
FIG. 3 is a partial sectional view of a fuel injector according to a prior art.

FIG. 3 shows a construction of the top part of the fuel injector according to a prior art. In the prior art, the second guide 7 is also located under the stopper plate 2 with the first guide 6.

Therefore, the lift stopper 10, the first guide 6 and the second guide 7 are located between the stopper plate 2 and the injection nozzle 4, instead of only the lift stopper 10 and the first guide 6 being located between the stopper plate 2 and the injection nozzle 4 in the present invention.

Accordingly, if the distance between the stopper plate 2 and the injector nozzle 4 of the fuel-injector according to the present invention is the same as that distance in the prior art fuel injectors, the fuel injector according to the present invention has a larger volume between the stopper plate 2 and the injection nozzle 4 than the prior art.

Consequently, the fuel injector according to the present invention can obtain a lower peak lean value of the air-fuel ratio of the intake mixture gas when restarting in a hot condition.

Figure 4:
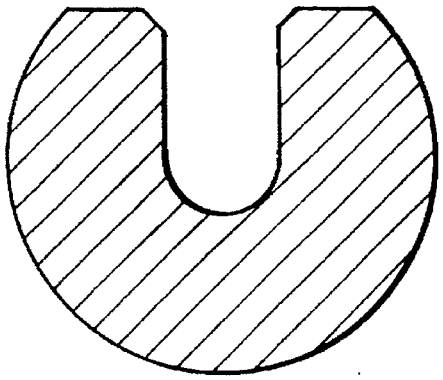
FIG. 4 is a sectional view of stopper plate taken along the Line IV—IV of FIG. 2 in the fuel injector according to the present invention.

FIG. 4 is a sectional view of the stopper plate 2 which is used in the fuel injector according to the present invention. The stopper plate 2 is horse-shoe shaped and is made by cutting out a part of an annular plate.

The cutout of the stopper plate 2 provides a path for communicating between the areas B and C, and fuel flows therethrough. The stopper plate 2 is arranged between the housing 1 and the valve body 3, so that the cutout is positioned uppermost when the whole fuel injector is attached to the intake manifold.

By the above described measure, bubbles generated between the stopper plate 2 and the nozzle 4 can easily go out and a lower peak lean value of the air-fuel ratio of the intake mixture gas can be obtained when restarting in a hot condition.

When a sufficient volume can not be provided between the stopper plate 2 and the nozzle 4, the above described measure can act to compensate for this lack of volume.

As explained above, according to the present invention, an increased volume can be obtained between the stopper plate and the injection nozzle without increasing the size of the valve body, thereby a relatively large amount of fuel liquid can remain in the top portion of the fuel injector and fewer bubbles are included in an initially injected fuel, and subsequently the fuel in the top portion of the injector is well cooled and the bubbles become smaller or disappear due to the large amount of cool fuel introduced into the volume, and as a result the fuel injector can begin to inject the correct amount of fuel in a shorter time and the initial firing and the following firings are improved.

Accordingly, it is not required to machine the inner circumference of the stopper plate which surrounds the shaft of the needle valve into a complicated form, thereby fewer man-hours are needed.

In addition to the above, an improved stability of the needle valve around the axis can be obtained, because the needle valve is supported by two guides which are a greater distance apart.

We claim:

1. A fuel injector for an internal combustion engine comprising:

a valve body having a nozzle at one end;

a stopper plate located at the other end of said valve body, said stopper plate having a stopper plate path for communicating between upstream and downstream sides of said stopper plate itself;

a needle valve slidably disposed in said valve body for opening and closing said nozzle;

a lift stopper fixed to said needle valve for limiting the stroke of said needle valve by being contacted with said stopper plate;

a first needle guide disposed at a downstream side of said lift stopper, said first needle guide having at least one first path for communicating between upstream and downstream sides of said first needle guide itself; and a second needle guide disposed at an upstream side of said lift stopper for guiding said needle valve in association with said first needle guide to correctly move said needle valve along its center axis, said second needle guide having at least one second path for communicating between upstream and downstream sides of said second needle guide itself, wherein the first needle guide is the only needle guide disposed on the downstream side of the lift stopper.

2. A fuel injector for an internal combustion engine according to claim 1, wherein, when said fuel injector is mounted in an intake passage of an engine, said stopper plate is oriented so that said stopper plate path extending upward relative to said valve body.

3. A fuel injector for an internal combustion engine according to claim 1, wherein said stopper plate is horse-shoe shaped and includes a cut-out portion which forms said stopper plate path.

4. A fuel injector for an internal combustion engine according to claim 1, wherein at least one of said first needle guide and said second needle guide is fixed to said needle valve.

5. A fuel injector for an internal combustion engine according to claim 4, wherein the at least one of said first needle guide and said second needle guide which is fixed to said needle valve is polygonally shaped and slidably contacts a cylindrically shaped inner surface of said valve body so that a plurality of the sides of the polygonally shaped needle guide provide said respective one of said first and second paths.

6. A fuel injector for an internal combustion engine according to claim 5, wherein the at least one of said first needle guide and said second needle guide which is fixed to said needle valve is composed of a polygonally shaped member and an annular armature attached to the corners of said polygonally shaped member, said annular armature slidably contacting the cylindrically shaped inner surface of said valve body, and the clearance between said polygonally shaped member and said annular armature forms said respective one of said first and second.

* * * * *

UNITED STATES PATENT AND TRADEMARK OFFICE

CERTIFICATE OF CORRECTION

PATENT NO. : 5,662,274

DATED : September 2, 1997

INVENTOR(S) : Nobuhiko KOGA, et al.

It is certified that error appears in the above-indentified patent and that said Letters Patent is hereby corrected as shown below:

ABSTRACT, line 13, after "communicating" insert --between--.

ABSTRACT, line 16, after "communicating" insert --between--.

Column 1, line 11, after "which" insert --is--.

Column 1, line 19, change "cause" to --causes--.

Column 1, line 24, change "horse-shoe" to --horseshoe--.

Column 1, line 25, change "Applications" to --Application--.

Column 1, line 30, change "man-hour" to --man-hours--.

Column 1, line 32, change "horse-shoe" to --horseshoe--.

Column 2, line 55, after "so that" delete "at four points in this".

Column 2, line 56, delete "embodiment, therefore".

UNITED STATES PATENT AND TRADEMARK OFFICE

CERTIFICATE OF CORRECTION

PATENT NO. : 5,662,274

DATED : September 2, 1997

INVENTOR(S) : Nobuhiko KOGA, et al.

It is certified that error appears in the above-indentified patent and that said Letters Patent is hereby corrected as shown below:

Column 3, line 5, at beginning of line change "which" to --with--.

Column 3, line 29, change "horse-shoe" to --horseshoe--.

Column 4, line 33, after "path" insert --is--.

Signed and Sealed this

Twenty-eighth Day of July, 1998

Bruce Lehman

*Attest:*

BRUCE LEHMAN

*Attesting Officer*

*Commissioner of Patents and Trademarks*